US005651656A

United States Patent [19]

Hapeman

[11] Patent Number: 5,651,656

[45] Date of Patent: Jul. 29, 1997

[54] RAIL TRANSPORTABLE RAMPS FOR LOADING SEMI-TRAILERS ON TRAINS

[75] Inventor: Martin Jay Hapeman, Edinboro, Pa.

[73] Assignee: General Electric Company, Erie, Pa.

[21] Appl. No.: 681,557

[22] Filed: Jul. 29, 1996

Related U.S. Application Data

[63] Continuation of Ser. No. 369,222, Jan. 6, 1995, abandoned.

[51] Int. Cl.[6] ..... B61D 47/00

[52] U.S. Cl. ..... 414/537; 105/159; 105/355; 414/339; 414/334; 414/346; 14/71.7

[58] Field of Search ..... 414/537, 538, 414/339, 334, 469, 480, 346, 571, 471, 430; 14/71.1, 71.3, 71.7, 69.5; 410/24, 56, 66, 82, 32; 254/93 R; 105/4.1, 159, 238.1, 355, 404

[56] References Cited

U.S. PATENT DOCUMENTS

| | | | |
|---|---|---|---|
| 1,716,170 | 6/1929 | Harvey | 105/159 |
| 3,153,489 | 10/1964 | Leavengood et al. | 105/159 X |
| 3,272,357 | 9/1966 | Freni | 414/339 |
| 3,854,423 | 12/1974 | Bridge | 105/368 |
| 3,926,128 | 12/1975 | Zappel | 105/159 X |
| 4,179,997 | 12/1979 | Kirwan | 105/159 X |
| 4,230,431 | 10/1980 | Stoller et al. | 410/59 |
| 4,472,100 | 9/1984 | Wagner | 414/481 |
| 5,017,065 | 5/1991 | Krug et al. | 410/58 |
| 5,216,956 | 6/1993 | Adams, Jr. | 105/159 X |
| 5,222,443 | 6/1993 | Engle | 105/355 |
| 5,249,532 | 10/1993 | Perrot | 105/355 |
| 5,443,353 | 8/1995 | Raymer | 414/339 X |

FOREIGN PATENT DOCUMENTS

| | | |
|---|---|---|
| 1145660 | 3/1963 | European Pat. Off. . |
| 0476180 | 3/1992 | Germany . |

OTHER PUBLICATIONS

European Search Report for application EP 95 30 9194.

*Primary Examiner*—Frank E. Werner
*Attorney, Agent, or Firm*—Marvin Snyder

[57] ABSTRACT

A ramp car for use in an intermodal train includes a ramp having a set of rail wheels mounted at one end and a connector at the one end for coupling the ramp car to a flat bed rail car. A second connector, including lifting apparatus, is operatively associated with a second end of the ramp car opposite the one end for coupling the ramp car to a locomotive. A coupling apparatus is provided at the second end of the ramp car for coupling to the locomotive to permit both raising and lowering the second end and pushing and pulling the ramp car. The second connector is disconnected from the ramp car when the ramp is in a lowered position. The second connector includes a rotatable pin mounted to the locomotive and extending vertically downward and having a pair of circumferentially spaced shoulders for bearing upwardly against a supporting surface on the ramp car to hold the ramp in a raised position. The pin is rotated to lock the ramp car to the rail car.

10 Claims, 2 Drawing Sheets

RAIL TRANSPORTABLE RAMPS FOR LOADING SEMI-TRAILERS ON TRAINS

This application is a continuation of application Ser. No. 08/369,222 filed Jan. 6, 1995, now abandoned.

BACKGROUND OF THE INVENTION

The present invention relates to intermodal trains for transport of semi-trailers and, more particularly, to a combination ramp and rail car for allowing semi-trailers to be driven onto such trains and for transporting a semi-trailer.

It has become common practice to transport semi-trailers by rail cars and special rail cars have been developed specifically for such purpose. These special cars are generally known as articulated flat cars and are designed to be coupled together in intermodal trains such that a semi-trailer can be driven over the cars from one end of the train to another end in a practice commonly referred to as circus style loading/unloading. Flat cars other than articulated cars are also used in circus style loading/unloading, using ramps extending between adjacent cars.

A general problem with loading/unloading semi-trailers on rail cars is how to raise/lower the trailers between ground level and the rail car bed. In some instances, loading is restricted to special loading platforms. At some locations, semi-trailers are lifted by overhead crane. Both these solutions are limiting since loading/unloading is restricted to those areas having such special facilities.

One method of loading semi-trailers on rail cars, as shown in U.S. Pat. No. 5,222,443, employs a ramp car constructed of two separable ramps extending toward each other and adapted to be locked together in a raised travel position. Opposite ends of the ramps are mounted to respective wheel sets such that the joined ramps are supported on the wheel sets for travel. The overall assembly is complex, requiring power and control means for assembling/disassembling the ramps. Furthermore, the assembled ramp car occupies space in the train and is unusable for any other purpose. Open space in a train increases wind drag and reduces fuel economy.

SUMMARY OF THE INVENTION

An object of the invention is to provide a rail transportable ramp for intermodal trains which overcomes the above and other disadvantages of the prior art.

Briefly, in accordance with a preferred embodiment of the invention, a ramp adapted to be positioned immediately aft of a locomotive is connectable to the locomotive in a position between the locomotive and a train of rail cars. One end of the ramp connects to the locomotive and an opposite end is provided with a wheel set. The one end includes means for lifting the ramp into engagement with a coupling on the locomotive. In one form, a hydraulic or pneumatic ram mounted to the locomotive attaches to the ramp and lifts the ramp into coupling engagement with the locomotive. The ram is disengageable while the ramp is coupled to the locomotive. The coupling includes a pivotable member to allow for relative pivoting of the locomotive with respect to the ramp. The ramp is adapted to support a semi-trailer, so that the space occupied by the ramp during transport is usable.

BRIEF DESCRIPTION OF THE DRAWINGS

The features of the invention believed to be novel are set forth in the appended claims. The invention, however, together with further objects and advantages thereof, may best be understood by reference to the following description taken in conjunction with the accompanying drawing(s) in which:

FIGS. 4A and 4B are side views of an end of a pin member for coupling the ramp car to the locomotive, while

DETAILED DESCRIPTION OF THE INVENTION

Figure 1:
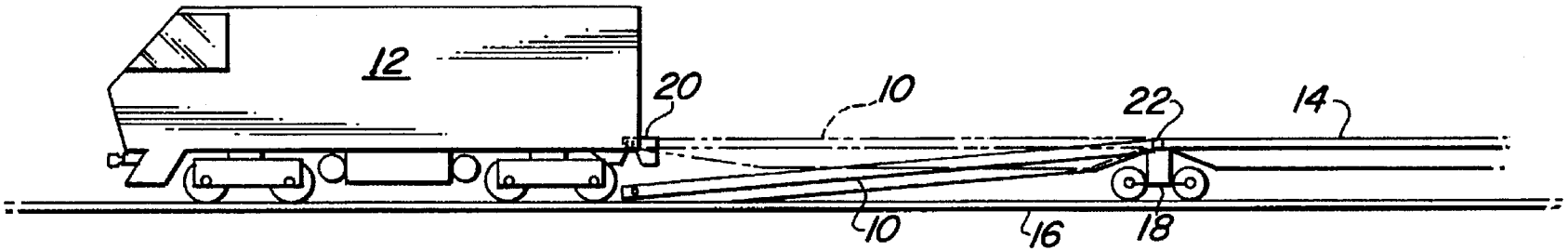
FIG. 1 is a simplified partial view of an intermodal train showing the ramp car of the invention coupled between a railroad locomotive and an articulated flat car.

FIG. 1 is a simplified elevation view of a section of an intermodal train incorporating a ramp car 10, in accordance with the present invention, coupled between a rail car, such as a locomotive 12, and a train of articulated rail cars 14 for operation on conventional tracks or rails 16. Ramp car 10 includes a rear wheel set 18 and a front connector 20. A rear connector 22 attached to wheel set 18 is a conventional connector for articulated rail cars and the ramp is extended on each side of connector 22 so as to eliminate gaps between the ramp and trailing rail car in the same manner as between successive cars in a train of articulated cars.

Figure 2:
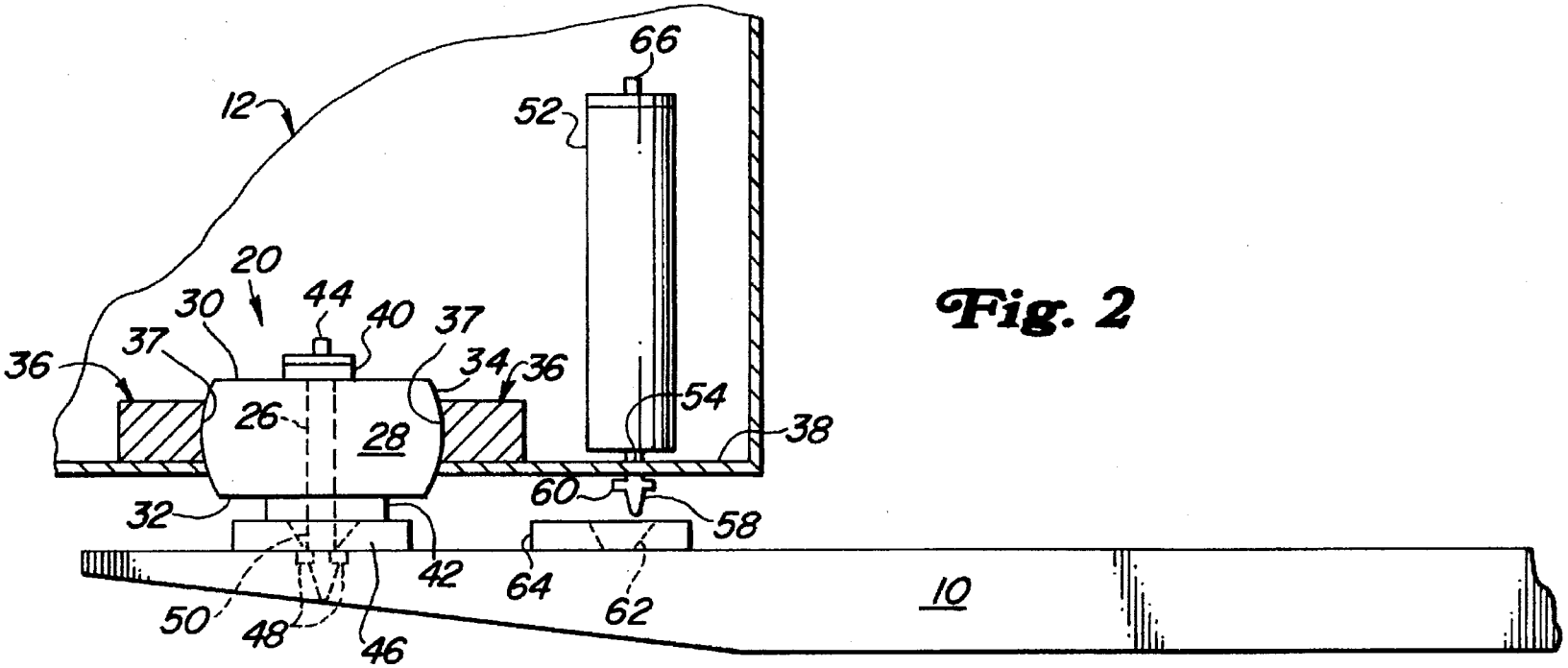
FIG. 2 is an enlarged view of the region of coupling between the ramp car and locomotive of FIG. 1, with the ramp car in a raised position.
Figure 3:
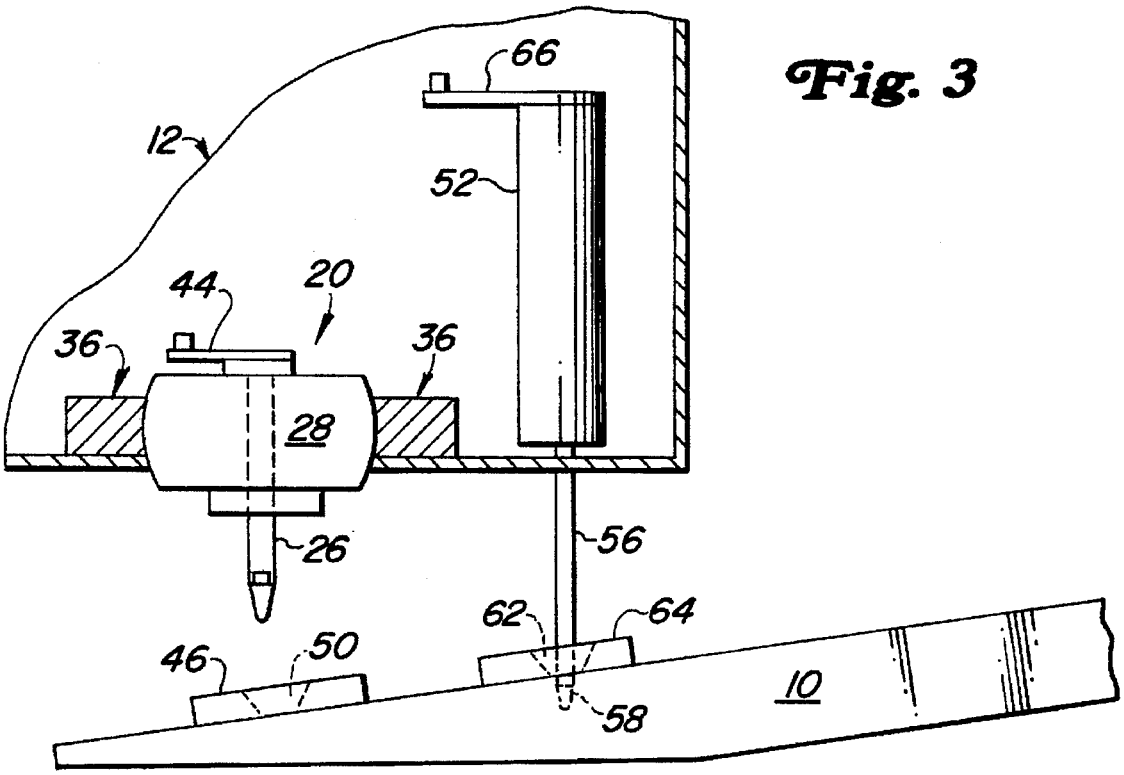
FIG. 3 is an enlarged view of the region corresponding to that shown in FIG. 2, showing the ramp car in a lowered position.

Front connector 20 may take any one of various forms so long as the connector incorporates sufficient strength to pull ramp car 10 and a selected number of trailing rail cars 14, and is further capable of allowing relative pivoting about a vertical axis and rolling about a horizontal axis. FIGS. 2 and 3 illustrate one form of connector 20 suitable for this purpose.

Connector 20, as shown in FIG. 2, includes a central pin 26 rotatably positioned in an annular support member 28 having flat upper and lower surfaces 30 and 32, respectively. Circumferential outer surface 34 of member 28 is radiused from upper surface 30 to lower surface 32 so that member 28 is retained within an outer bearing member 36 having an inner surface 37 mating with member 28. The combination of support member 28 and bearing member 36 comprises what is essentially a ball joint that allows member 28 to be angularly displaced with respect to a floor 38 of locomotive 12. Pin 26 is attached to an upper plate 40 and a lower plate 42 slidably engaging surfaces 30 and 32, respectively, of bearing member 28. Pin 26 may be welded to each of plates 40 and 42. A handle 44, best seen in FIG. 3, is attached to the upper end of pin 26 to allow the pin to be manually rotated between a locked and an unlocked position. The locked position, shown in FIG. 2, supports ramp car 10 in a raised position for transport.

Figure 4A:
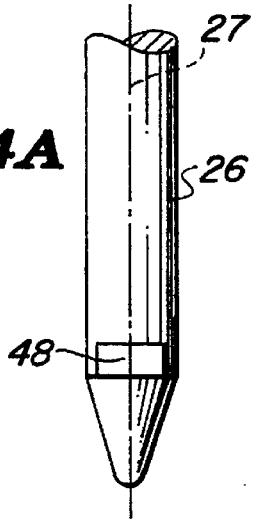
Figure 4B:
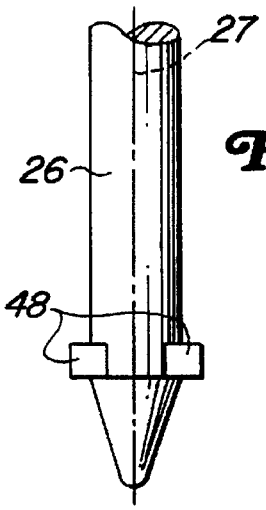
Figure 4C:
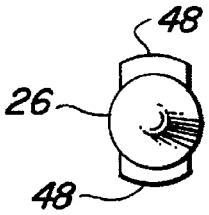
FIG. 4C is an end view of the pin member.

When ramp car 10 is coupled to locomotive 12, a plate 46, welded, riveted, bolted or otherwise affixed to the upper surface of ramp car 10, is held in engagement with lower plate 42 on bearing member 28. Pin 26 includes a pair of circumferentially spaced tabs or shoulders 48, best seen in FIGS. 4A–4C. FIGS. 4A and 4B are side views of the end of pin 26 rotated 90° from each other about the pin axis 27, and FIG. 4C is a bottom view of pin 26. Shoulders 48 support the ramp car vertically, as shown in FIG. 2, while transverse forces associated with pulling or pushing the ramp car along the rails are transferred through pin 26 to support member 28. Pin 26 projects through a slot 50 in plate 46 and is rotated 90° to lock the pin to the plate.

The forward end of ramp car 10 is raised and lowered by, for example, a pneumatic or hydraulic actuator 52 pivotally mounted to locomotive 12. The pivotable mount 54 may be a ball socket or a flexible insert in locomotive floor 38 with an end of actuator 52 being positioned to react against floor 38. Mount 54, which may alternatively be a smaller version of ball joint 20, allows actuator 52 to tilt laterally at an angle relative to floor 38 to accommodate displacement of the ramp car end as it is raised and lowered. Actuator 52, as can be seen in FIG. 3, includes a piston rod 56 of sufficient length to reach ramp car 10 in its lowered position. The end 58 of rod 56, in a fashion similar to pin 26, includes a pair of shoulders 60 (FIG. 2) adapted to be passed through an aperture 62 in a plate 64 affixed to ramp car 10. As can be seen by comparison of FIGS. 2 and 3, a handle 66 is attached to an upper end of actuator 52 in a manner that allows rod 56 to be rotated. More particularly, rod 56 is inserted into aperture 62 with shoulders 60 oriented as shown in FIG. 2, and is then rotated 90° to engage shoulders 60 with the lower sides of plate 64, as shown in FIG. 3. Operation of actuator 52 then serves to raise or lower ramp car 10. When ramp car 10 is in the raised position, rod 56 is disconnected from the car so that no transverse or lateral force is placed on actuator 52. However, it is contemplated that a combined raising/lowering mechanism could be constructed to couple ramp car 10 to locomotive 12, thereby eliminating any need for a separate coupler 20.

While means for raising and lowering ramp car 10 have been shown and described as a hydraulic or pneumatic actuator, it will be apparent that numerous other devices can be used for this purpose. For example, the ramp car could be raised by a cable and a motor driven pulley, or by a manually actuated or motor driven screw jack. Further, the means for attaching car 10 to locomotive 12 could be adapted from conventional railroad car articulated couplers.

A significant feature of the invention is the use of ramp car 10 as a load-carrying flat car for intermodal transportation. When the flat cars of an articulated group have been loaded by driving semi-trailers onto the cars via ramp car 10, a final semi-trailer is placed on car 10 before raising car 10 into the transport position. Actuator 52 can be operated to provide sufficient force to raise/lower an end of car 10 with a loaded semi-trailer in position on the car. For this dual purpose, ramp car 10 should have a length of at least 34 feet for carrying a semi-trailer of about 28 feet.

It will be appreciated that ramp car 10 can be used in other positions of an intermodal train so long as an adjacent rail car is provided with means for coupling to, and supporting, the free end of the ramp car. Furthermore, coupling 20 and actuator 52 could be combined in a manner that would permit rod 56 to be used in place of pin 26. This modification would simplify construction of the ramp car by eliminating one pivotable joint and mating aperture.

While only certain preferred features of the invention have been illustrated and described, many modifications and changes will occur to those skilled in the art. It is, therefore, to be understood that the appended claims are intended to cover all such modifications and changes as fall within the true spirit of the invention.

What is claimed is:

1. Apparatus for allowing highway vehicles to be moved onto or off of a flat bed rail car in an intermodal railroad train made up of a plurality of rail cars on a pair of rails, wherein said plurality of rail cars includes said flat bed rail car, said flat bed rail car having a set of rail wheels at each end thereof adapted to roll on said rails, said apparatus comprising:

a ramp adapted to support one of said highway vehicles on said ramp;

first connector means affixed to said one end of said ramp for coupling said ramp to said one end of said flat bed rail car;

second connector means operatively associated with a second end of said ramp opposite said one end, for coupling said ramp to another one of said rail cars, said second connector means being adapted to be affixed to said another one of said rail cars and being in disengagement from said another one of said rail cars to permit highway vehicle motion over said ramp while said flat bed rail car is stationary; and coupling means mounted on said ramp at said second end thereof and adapted to engage said second connector means to allow said ramp to be raised or lowered at said second end and locked in place when said ramp is in a raised position at said second end to allow said ramp to be pushed or pulled from said another one of said rail cars;

said ramp, when in a lowered position, being adapted to support said highway vehicles as they pass thereover while being moved onto, or off of, said flat bed rail car;

said first connector means being adapted to allow said ramp to push or pull said flat bed rail car when said ramp is in a raised position at said second end.

2. Apparatus for allowing highway vehicles to be moved onto or off of a flat bed rail car in an intermodal railroad train made up of a plurality of rail cars on a pair of rails, wherein said plurality of rail cars includes said flat bed rail car, said flat bed rail car having a set of rail wheels at each end thereof adapted to roll on said rails, said apparatus comprising:

a ramp adapted to support one of said highway vehicles on said ramp;

first connector means affixed to said one end of said ramp for coupling said ramp to said one end of said flat bed rail car;

second connector means operatively associated with a second end of said ramp opposite said one end, for coupling said ramp to another one of said rail cars, said second connector means being adapted to be affixed to said another one of said rail cars said second connector means comprising a pin extending vertically downward from said another one of said rail cars, said pin having at least a pair of circumferentially spaced shoulders, said coupling means including a supporting surface against which the shoulders bear in an upward direction to hold said second end of said ramp car in a raised position; and coupling means mounted on said ramp at said second end thereof and adapted to engage said second connector means to allow said ramp to be raised or lowered at said second end and locked in place when said ramp is in a raised position at said second end to allow said ramp to be pushed or pulled from said another one of said rail cars;

said ramp, when in a lowered position, being adapted to support said highway vehicles as they pass thereover while being moved onto, or off of, said flat bed rail car;

said first connector means being adapted to allow said ramp to push or pull said flat bed rail car when said ramp is in a raised position at said second end.

3. The apparatus of claim 2 wherein said supporting surface of said coupling means defines a slotted opening, said pin being rotatable to allow said shoulders to be rotated away from said slotted opening and thereby lockingly engage said coupling means.

4. The apparatus of claim 2 wherein said another one of said rail cars comprises a locomotive and said second connector means includes a hydraulic actuator.

5. The apparatus of claim 4 wherein said hydraulic actuator includes a piston rod extending vertically downward and having means for releasably connecting an end of said rod to said coupling means at said second end of said ramp.

6. The apparatus of claim 4 wherein said hydraulic actuator is pivotally mounted to said another one of said rail cars.

7. The apparatus of claim 2 wherein said pin is mounted within a ball joint whereby said pin is angularly displaceable with respect to said another one of said rail cars.

8. The apparatus of claim 2 wherein said another one of said rail cars comprises a locomotive and said second connector means includes a pneumatic actuator.

9. The apparatus of claim 8 wherein said pneumatic actuator includes a piston rod extending vertically downward and having means for releasably connecting an end of said rod to said coupling means at said second end of said ramp.

10. The apparatus of claim 8 wherein said pneumatic actuator is pivotally mounted to said another one of said rail cars.

* * * * *